US006089856A

United States Patent [19]

Wolcott et al.

[11] Patent Number: 6,089,856

[45] Date of Patent: Jul. 18, 2000

[54] PILOT CONTROL ASSEMBLY

[75] Inventors: Christopher J. Wolcott, East Peoria; Roger A. Shafer, Bartonville, both of Ill.

[73] Assignee: Gas Electronics, Inc., Peoria, Ill.

[21] Appl. No.: 09/312,582

[22] Filed: May 14, 1999

Related U.S. Application Data

[62] Division of application No. 08/893,268, Jul. 15, 1997, Pat. No. 5,927,963.

[51] Int. Cl.[7] ..... F23N 5/00

[52] U.S. Cl. ..... 431/18; 431/70; 431/75; 431/266

[58] Field of Search ..... 431/18, 70, 75, 431/278, 266, 264, 281, 202, 265, 285, 344, 350, 258, 255; 126/407, 414

[56] References Cited

U.S. PATENT DOCUMENTS

| | | |
|---|---|---|
| 517,721 | 4/1894 | Slawson . |
| 655,176 | 8/1900 | Ackermann . |
| 2,448,497 | 8/1948 | Rosche . |
| 2,564,596 | 8/1951 | Dahline . |
| 2,564,597 | 8/1951 | Dahline . |
| 2,577,787 | 12/1951 | Mayer et al. . |
| 2,579,884 | 12/1951 | Thomson et al. . |
| 2,622,669 | 12/1952 | Caracristi et al. . |
| 2,664,234 | 12/1953 | Selgem et al. . |
| 2,666,480 | 1/1954 | Peterson . |
| 2,864,234 | 12/1958 | Seglem et al. . |
| 3,236,284 | 2/1966 | Kemper . |
| 3,261,008 | 7/1966 | Schreter et al. . |
| 3,302,685 | 2/1967 | Ono et al. . |
| 3,327,758 | 6/1967 | Cleall . |
| 3,529,584 | 9/1970 | Celaya . |
| 3,620,658 | 11/1971 | Tappin . |
| 3,701,137 | 10/1972 | Hulsman . |
| 3,915,625 | 10/1975 | Hapgood . |
| 4,147,494 | 4/1979 | Ando et al. . |
| 4,298,336 | 11/1981 | Riehl . |
| 4,311,452 | 1/1982 | Begin . |
| 4,346,055 | 8/1982 | Murphy et al. . |
| 4,391,582 | 7/1983 | Cowan . |
| 4,427,363 | 1/1984 | Hammond . |
| 4,431,400 | 2/1984 | Kobayashi et al. . |
| 4,519,771 | 5/1985 | Six et al. . |
| 4,541,798 | 9/1985 | Miller et al. . |
| 4,552,528 | 11/1985 | Gaiffier . |
| 4,561,839 | 12/1985 | Neumann . |
| 4,595,354 | 6/1986 | Guerra . |

(List continued on next page.)

*Primary Examiner*—James C. Yeung
*Attorney, Agent, or Firm*—Wallenstein & Wagner, Ltd.

[57] ABSTRACT

A pilot burner assembly for a gas burning heater which has a pilot fuel supply pipe and a pilot burner head with an inner chamber defined by a generally continuous sidewall. The pilot burner head has a middle body region with a side port defining a channel passing through the sidewall which has a channel wall. An ignitor rod passes at least partially into the port and terminates at an ignitor tip which is adapted to provide electrical current between the ignitor tip and the sidewall to ignite a pilot flame. A boss is welded on the burner head and surrounds the port. An insulation sleeve is positioned within the boss and has a central aperture adapted to allow passage of the ignitor rod and maintain the ignitor rod in position. A pilot flame sensor is positioned adjacent the pilot burner head and adapted to indicate the ignited pilot flame to a computerized control means. The control means operates a pilot fuel supply valve and the ignitor rod to initiate spark at the ignitor tip and ignite the pilot fuel when the pilot flame is not indicated by the sensor. The control means is also adapted to operate the main valve solenoid to close the main valve when no pilot flame is detected, and optionally maintains the pilot valve open with electrical current of decreased voltage when the sensor indicates a pilot flame. The control means further has an on-demand toggle switch having a first position whereby the control means provides electrical current to open the pilot valve and current to the ignitor rod when the burner demand indicator indicates demand for the burner and the sensor indicates no pilot flame to provide on-demand pilot flame.

9 Claims, 2 Drawing Sheets

U.S. PATENT DOCUMENTS 4,629,414 12/1986 Buschulte et al. .
4,662,838 5/1987 Riordan .
4,711,629 12/1987 MacDonald .
4,871,307 10/1989 Harris et al. .
4,891,004 1/1990 Ballard et al. .
4,915,614 4/1990 Geary .
4,946,384 8/1990 London .
4,946,394 8/1990 London .
4,972,152 11/1990 Finn .
4,976,605 12/1990 Geary .
5,020,988 6/1991 Peterson .
5,055,825 10/1991 Yang .
5,073,104 12/1991 Kemlo .
5,085,040 2/1992 Tilston .
5,106,293 4/1992 Hawkins .
5,203,687 4/1993 Oguchi .
5,222,889 6/1993 Hsu .
5,267,849 12/1993 Paciorek .
5,360,335 11/1994 Anderson et al. .
5,364,260 11/1994 Moore .
5,368,471 11/1994 Kychakoff et al. .
5,372,497 12/1994 Coolidge et al. .
5,425,631 6/1995 Krueger et al. .
5,429,496 7/1995 Stephens et al. .
5,432,095 7/1995 Forsberg .
5,433,117 7/1995 Taphorn et al. .
5,433,601 7/1995 Buschulte et al. .
5,435,717 7/1995 Bohan, Jr. et al. .
5,439,374 8/1995 Jamieson .
5,453,002 9/1995 Scott .
5,460,515 10/1995 Harbeck et al. .
5,468,142 11/1995 Koziol .
5,472,336 12/1995 Adams et al. .
5,472,337 12/1995 Guerra .
5,472,340 12/1995 Lynch .
5,478,232 12/1995 Dillinger et al. .
5,503,549 4/1996 Iasella ..... 431/18
5,506,569 4/1996 Rowlette .
5,531,584 7/1996 Jacques .
5,534,781 7/1996 Lee et al. .
5,538,416 7/1996 Peterson et al. .
5,557,050 9/1996 Campain et al. .
5,571,007 11/1996 Ishiguro et al. .
5,577,905 11/1996 Momber et al. .
5,599,180 2/1997 Peters et al. .
5,607,294 3/1997 Gianpiero et al. .
5,616,022 4/1997 Moran, IV .
5,622,200 4/1997 Schulze .
5,636,978 6/1997 Sasaki ..... 431/18

PILOT CONTROL ASSEMBLY

RELATED APPLICATIONS

This application is a divisional of application Ser. No. 08/893,268 filed Jul. 15, 1997, now U.S. Pat. No. 5,927,963 which is herein incorporated by reference.

TECHNICAL FIELD

The present invention relates to gas burner pilot assemblies and control systems for gas burners ignited by a pilot flame. More specifically, the present invention relates to gas burner pilot assembly and control systems for use in fuel pipeline heaters.

BACKGROUND OF THE INVENTION

A specialized type of heater apparatus is necessary for use on natural gas pipelines. The need for such heaters arises when there is a reduction in the pressure of the natural gas within the pipeline, such as is typically the case when a percentage of the gas in a main line is diverted to a separate pipeline to service a municipality, or the like. The sudden loss in internal pipeline pressure results in potential undesirable condensation of hydrocarbons in the pipeline, potentially resulting in obstruction or faulty flow of gas. This possible condensation problem is avoided by heating the pipeline through the use of the specialized pipeline heater.

Pipeline heaters are typically needed in locations along the pipeline that are remote, often being without any electrical supply available to operate the heater. Typical types of such heaters include indirect or dehydration heaters, most often heating a heat-transferring substance, such as glycol, by a gas burner. The gas burner is ignited by a pilot light, the pilot light being a smaller gas burning flame.

The types of such heaters in use today often include manually operated pilot flame ignition, without safety features for providing reliable relighting of an extinguished pilot or main burner shut-off features. Therefore, the burners presently being used are not reliable for avoiding hydrocarbon condensation in the pipeline, and do not have much needed safety features for detecting and reacting to burner pilot flame failure. Further, the burners presently used have continual pilot flames, regardless of infrequent burner use, resulting in wasted fuel of unnecessary pilot burn time.

Also, the burners presently in use have a pilot assembly having a structure which have an ignitor terminal extending into the pilot flame, resulting in deterioration of the ignitor terminal due to constant exposure in the pilot flame and/or loss of the important tolerance of the spacing of the ignitor terminal to the area of the pilot for conducting spark.

The present invention resolves these problems in the field, primarily by providing a specific structure of a pilot assembly, and by providing a pilot control means which optionally provides a continuous burning pilot or provides an on-demand pilot, both such pilot operations having safety features for shutting down the main burner valve and relighting the pilot, in the event it is extinguished.

SUMMARY OF THE INVENTION

It is an object of the present invention to provide a pilot burner assembly for a gas burning heater which has a pilot fuel supply pipe and being adapted to provide a flow of combustible gaseous fuel. A pilot burner head has an inner chamber defined by a generally continuous sidewall and being in fluid communication with the fuel supply pipe inner channel. The pilot burner head has a middle body region with a side port defining a channel passing through the sidewall which has a channel wall. An ignitor rod passes at least partially into the port and terminates at an ignitor tip which is adapted to provide electrical current between the ignitor tip and the sidewall to cause combustion of the gaseous fuel to an ignited pilot flame.

It is also an object of the present invention to provide such a pilot assembly also having a boss welded on the burner head and surrounding the port. An insulation sleeve is positioned within the boss and has a central aperture adapted to allow passage of the ignitor rod and maintain the ignitor rod in position.

It is also an object of the present invention to provide a pilot flame sensor positioned adjacent the pilot burner head and adapted to identify the ignited pilot flame and indicate the same to a computerized control means. The control means is adapted to control open a pilot fuel supply valve and the ignitor rod to initiate spark at the ignitor tip and ignite the pilot fuel when the pilot flame is not indicated by the sensor. The control means is also adapted to open the pilot fuel valve with electrical current and to maintain the valve open with electrical current of decreased voltage when the sensor signals indication of the pilot flame.

Other advantages and aspects of the invention will become apparent upon making reference to the specification, claims, and drawings to follow.

DETAILED DESCRIPTION

Figure 1:
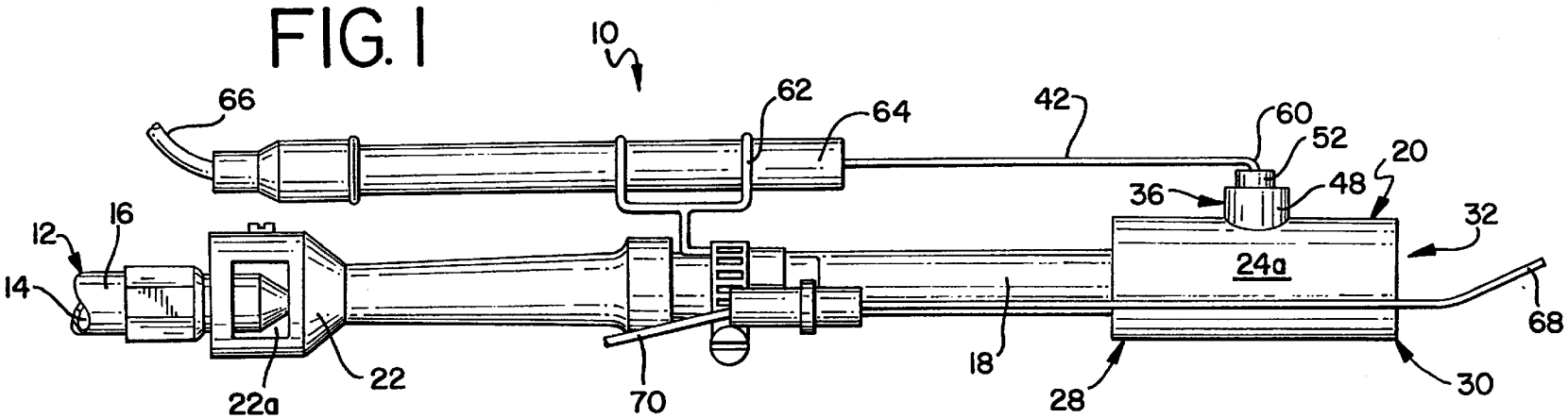
FIG. 1 is a side view of the pilot assembly of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is an improved structure and working system for a burner assembly for providing pilot burner ignition of a gas burner heating apparatus, such as is typically used in the field of natural gas pipeline and distribution heaters (i.e., indirect or dehydration heaters for natural gas pipeline and distribution systems).

The pilot assembly 10 has a pilot fuel supply which is provided by a pilot fluid supply pipe 12. The pipe 12 has an inner channel 14, and is adapted to provide a flow of combustible gaseous fuel through the pipe, the fuel passing from a proximal end 16 of the pipe 12, which is in fluid communication with a pilot fuel control valve (not shown), to a distal end 18 of the pipe 12 which is in fluid communication with a pilot burner head 20. Preferably, the pipe 12 is aligned with a first central axis of the assembly, the central longitudinal axis 20*a* of the pilot head 20. Also, the pipe 12 distal end 18 is preferably threaded into a threaded plug insert 27*a* of the pilot head. The pipe 12 has a venturi means 22 with at least one opening 22*a* to expose air to the pipe inner channel 14 and being adapted to mix air with the fuel supply passing through the proximal end 16 of the pipe 12. Therefore, the distal end 18 of the pipe 12 receives a gas/air mixture as pilot fuel.

The pilot burner head 20 has an inner chamber 26 which is defined by a generally continuous sidewall 24. The proximal end 28 of the pilot head 20 is integrally attached to the pipe distal end 18 such that the inner chamber 26 of the pilot head 20 is in fluid communication with the pipe 12 and also receives gas/air mixture of fuel supply. Preferably, the fuel supply from the pipe 12 passes through a port 27 having a diameter approximately less than ½ of the pipe 12 inner diameter. In the preferred form of the invention, the port 27 is formed by a threaded plug 27*a* inserted into the proximal end 28 of the pilot head 20, with threading suitable for threaded insertion of the pipe distal end 18. The pilot head further has a distal end 30 with an opening 32 leading into the inner chamber 26. A middle body region 34 of the pilot head 20 lies between the pilot head proximal end 28 and distal end 32.

Figure 3:
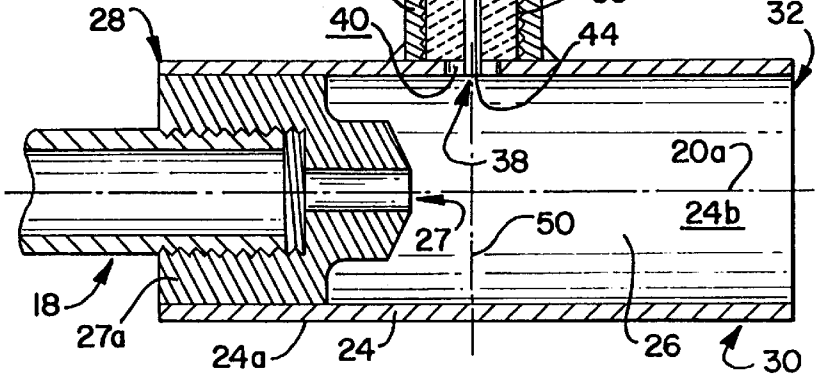
FIG. 3 is a sectional view of the burner head and pipe shown in FIG. 1.
Figure 2:
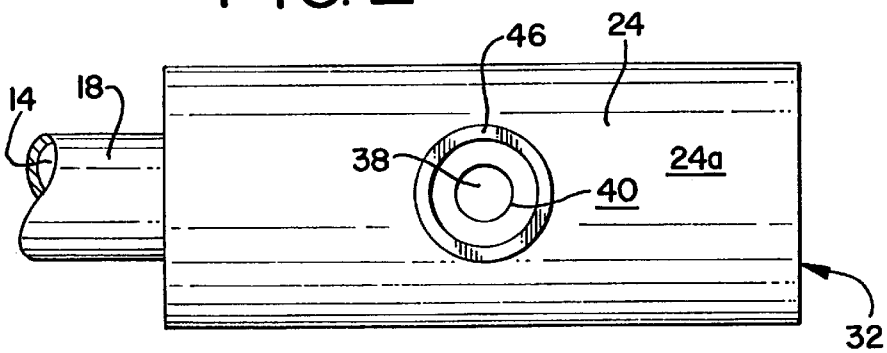
FIG. 2 is a top plan view of the burner head of the pilot assembly of the present invention, with the ignitor rod and the insulator sleeve removed.

The pilot head 20 has a side port 36, with a channel 38, appearing as a small opening in the sidewall 24 of the pilot head 20. The channel 38 is located in the middle body region 34 of the pilot head 20, and is an opening in fluid communication with the inner chamber 26 of the head 20. The channel has a diameter which is defined by a channel wall 40. In the preferred embodiment, the channel wall 40 is the thickness of the sidewall 24, resulting from forming a hole through the sidewall 24 in the middle body region 34 of the pilot head 20, as shown in FIG. 3. However, it is contemplated that the channel wall may include an extended portion which protrudes into the inner chamber 26 of the pilot head 20, such as an extended portion into the chamber 26 beyond the sidewall inner surface 24*b*. As is discussed in greater detail herein, one important aspect of the present invention is that the port 36 provides a passageway for an ignition rod 42 to pass into the inner chamber 26 of the pilot head 20, and the channel wall 40 provides a surface for the tip 44 of the ignition rod 42 to spark to ignite a pilot flame. The fact that the channel wall 40 and the tip 44 are in the middle body portion 34 provides a positioning of the tip 44 below the position of the ignited pilot flame in the head 20.

A boss 46 is located on the sidewall outer surface 24*a* of the pilot head 20. The boss 46 has a boss wall 48 which surrounds the port 36, preferably evenly surrounding the channel 38 and having a diameter substantially greater than the channel. The boss wall 48 is circumferentially disposed about a second central axis 50 which is generally transverse to the first central axis (the pilot head central longitudinal axis 20*a*).

The ignitor rod 42 passes through the boss 46, and at least partially into the port 36, and terminates at the ignitor tip 44 positioned adjacent the channel wall 40. The ignitor 42 is adapted to provide electrical current between ignitor tip 44 and the sidewall 24 to cause combustion of the gaseous fuel being supplied through the proximal end 28 of the pilot head 20. This results in ignition of a pilot flame which bums partially in the burner head 20 (from the middle body region 34 and toward the distal end 30), and partially outside the opening 32 at the distal end 30 of the head 20. The ignitor tip 44 is preferably located in the middle body region 34 of the burner head 20, the location which is below the ignited pilot flame. In the preferred embodiment, the ignitor tip is located at approximately the middle of the pilot head 20, preferably toward the distal end 30 immediately adjacent the fuel supply port 27 within the inner chamber 26.

An insulation sleeve 52 is positioned with the boss 46, and has a central aperture 48 which has an aperture size suitable to allow passage of the ignitor rod 42. The sleeve 52 preferably has a height which extends above the sidewall outer surface 24*a* of the pilot head 20 greater than the overall height of the boss wall 48, as is shown in FIGS. 1 and 3. Another important aspect of the present invention is the arrangement and spatial relationship between the ignitor rod 42 and/or the tip 44 to the metal of the pilot head 20. More specifically, the ignitor tip 44 is maintained at an optimal distance from the channel wall 40 for the conduction of electrical current between those two parts to provide and adequate spark to ignite the pilot flame. This optimal distance is approximately ⅛ inch. Therefore, the channel wall preferably has a diameter which result in the tip 44 to be spaced approximately ⅛ inch away. Further, the insulating sleeve 52 insulates the rod 42 from being exposed to the boss wall 48, by insulating between the rod 42 and the inner surface of the wall 48, and by the sleeve 52 having a height which extends beyond the height of the wall 48. In the preferred embodiment, therefore, the boss wall 48 has a height of approximately ⅜ inch above the outer surface 24*a* and the sleeve has a height of approximately ½ inch above the outer surface 24*a*. Further, the channel 38 has a diameter of approximately 11/32 inch and the ignitor tip 44 has a thickness of approximately 3/32 inch, with the ignitor passing directly through the middle of the channel 38 (thereby providing ⅛ inch between the tip 44 and the channel wall 40).

In the preferred embodiment, the boss wall 48 has an inner threading 56. The threading preferably is adapted to accommodate threaded insertion of a spark plug with like threading. For example, the inner threading 56 of the boss wall 48 preferably has a 14 millimeter diameter and a 1.25 millimeter thread spacing, thereby being suitable to accommodate an automotive spark plug, commercially identified as an Autolite 456 model spark plug. This optional accommodation of a spark plug provides the option of igniting the pilot flame with a spark plug (not shown) by removal of the ignitor rod 42 and insulating sleeve 52, and threaded insertion of the desired spark plug.

The ignitor rod 42 has a bend 60, preferably approximately a right angle bend, immediately adjacent the sleeve 52. The bend 60 prevents the rod 42 from passing further into the channel 38 than the preferred position of having the tip 44 proximate to the channel wall 40. The ignitor rod 42 is also held in position by an igniter brace 62 which is mounted to the pipe 12 and is attached to the ignitor rod 42 through a brace insulator sleeve 64. Attached to the ignitor rod 42 is an electrically conductive ignitor wire 66. The ignitor wire 66 provides electrical connection of the ignitor rod 42 to the power supply (not shown), preferably through a computerized control means described further below.

A pilot flame sensor 68 is positioned adjacent the opening 32 at the distal end 30 of the pilot head 20. The pilot flame sensor 68 is thereby positioned in the area where the pilot burns outside the pilot head, and is adapted to indicate the existence of a pilot flame. In the preferred embodiment, the sensor 68 is a flame probe which identifies ionization which results from the burning pilot flame. The sensor 68 indicates the presence/absence of a pilot flame to a computerized control means (explained further below) which is connected to the sensor by a sensor wire 70. When the sensor indicates that a pilot flame is not present, the control means controls the ignitor rod by providing current through the wire 66 and the rod 42 to initiate spark at the ignitor tip 44 between the tip 44 and the channel wall 40. The computerized control means is also electrically connected to a pilot fuel supply valve 110 which is in fluid communication with the pilot supply pipe 12, and is connected to the proximal end of the pipe 12. The control means controls the pilot valve to open the valve with electrical current, and maintains the pilot valve open with electrical current of decreased voltage when the pilot flame sensor 68 senses pilot flame and indicates the same through the sensor wire 70.

Figure 4:
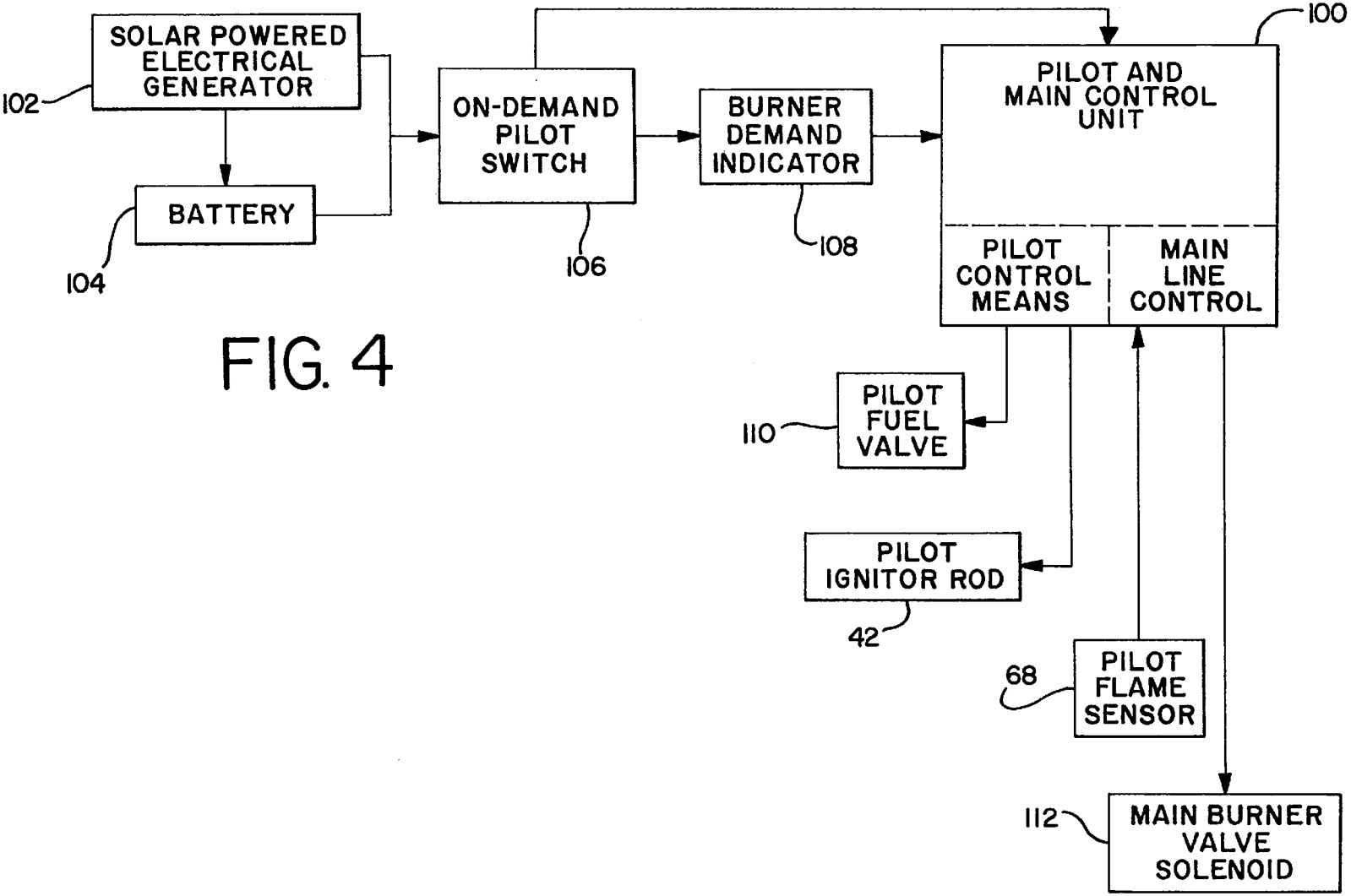
FIG. 4 is a block diagram of the pilot and burner control system of the present invention.

As is shown in the block diagram of FIG. 4, the present invention provides a pilot control means associated with the pilot and main control unit 100. As with most such devices in use for controlling the heater operation on a pipeline, the assembly receives electrical power from the solar powered electrical generator 102, which provides power to charge the back-up power supply of a battery 104. The power supply 102, 104 is electrically connected to an on-demand pilot switch 106, which is essentially a toggle switch that is manually operated to toggle between a first position wherein electrical current by-passes the burner demand indicator 108 to directly power the pilot control means, and a second toggle position wherein the electrical current passes to the burner demand indicator 108. Operation of the toggle switch 106 between the first and second position provides manual selection of a constant pilot flame (when the demand indicator 108 is by-passed) and an on-demand pilot flame (signaling the pilot control 100 only when the indicator 108 indicates need for the main heater burner).

The pilot and main control means 100 is electrically connected to the pilot fuel valve 110 and the pilot ignitor rod 42, and receives indication of whether a pilot flame is lit from the pilot flame sensor 68. In operation, when the pilot sensor 68 indicates that there is no pilot flame (though the unit is to have a continual pilot, or the burner indicator 108 signals that the burner is needed), the pilot and main control means 100 signals the main burner valve solenoid 112 (resulting in closure of the main burner valve) and also signals the pilot fuel valve 110 to open while causing electrical current to pass through the ignitor rod 42, thereby resulting in spark between the tip 44 and the burner head 20 to light the pilot flame. When the pilot flame is detected by the sensor 68, which indicates such to the control means 100, the control means 100 signals the main burner valve solenoid 112 to allow the main burner valve to open, and the control means 100 maintains the pilot fuel valve 110 in the open position with an electrical current of a reduced voltage, preferably the minimal voltage required for the pilot valve to be maintained open. For example, in a preferred embodiment, the control means 100 opens the pilot valve 110 with a 12 volt electrical current and maintains the valve open with only a 6 volt current.

While specific embodiments have been illustrated and described, numerous modifications come to mind without significantly departing from the spirit of the invention and the scope of protection is only limited by the scope of the accompanying claims.

We claim:

1. A control system for a gas burner heater assembly for use in heating a fuel pipeline, comprising a burner control means adapted to receive a signal from a pilot flame sensor and being electrically connected to a main valve solenoid and a pilot fuel valve and a pilot ignitor rod;

an on-demand pilot toggle switch having a first position whereby the control means provides electrical current to open the pilot valve and to spark the ignitor rod when the pilot flame sensor indicates no pilot flame to provide continual pilot burning, and a second position whereby the control means provides electrical current to open the pilot valve and current to the ignitor rod when the burner demand indicator indicates demand for the burner and the sensor indicates no pilot flame to provide on-demand pilot flame.

2. The control system of claim 1, wherein, when the toggle is in said second position, the control means has a igniting sequence of providing current to open the pilot valve and to spark the ignitor continuously until the sensor indicates a pilot flame, and the control means has an operational sequence of maintaining the pilot valve open and providing current to a main valve solenoid to permit opening of a main valve, and said control means has a non-operational sequence of closing the pilot valve and controlling the main valve solenoid to close the main valve.

3. The control system of claim 1, wherein the control means is adapted to provide electrical current with a voltage sufficient to open said pilot valve, and subsequently provide a reduced voltage of said electrical current adapted to maintain the pilot valve open.

4. The control system of claim 3, wherein the control means is adapted to provide electrical current at approximately 12 volts to open said pilot valve and subsequently provide electrical current at approximately 6 volts for maintaining the pilot valve open.

5. The control assembly of claim 3, wherein the control means is adapted to provide for less than 1 second duration said electrical current sufficient to open the pilot valve.

6. A control system for a gas burner heater assembly for use in heating a fuel pipeline, comprising;

a burner control means adapted to receive a signal from a burner demand indicator and being electrically connected to a main valve solenoid and a pilot fuel valve and a pilot ignitor rod;

an on-demand pilot toggle means having a first function of operation whereby the control means provides electrical current to the pilot fuel valve for said pilot valve to be open, and a second function of operation whereby the control means provides electrical current to the pilot fuel valve and the pilot ignitor rod after receiving signal from the burner demand indicator that indicates demand for the burner.

7. The control system of claim 6, wherein the control means is adapted to provide electrical current to the pilot valve with a voltage sufficient to open said pilot valve, and subsequently provide a reduced voltage of said electrical current to the pilot valve adapted to maintain the pilot valve open.

8. The control system of claim 7, wherein the control current adapted to provide electrical current at approximately 12 volts to open said pilot valve and subsequently provide electrical current at approximately 6 volts for maintaining the pilot valve open.

9. The control assembly of claim 7, wherein the control means is adapted to provide for less than 1 second duration said electrical current sufficient to open the pilot valve.

* * * * *